United States Patent [19]

Igarashi

[11] Patent Number: 4,701,728

[45] Date of Patent: Oct. 20, 1987

[54] WAVEGUIDE FILTER

[75] Inventor: Sadao Igarashi, Soma, Japan

[73] Assignee: Alps Electric Co., Ltd., Japan

[21] Appl. No.: 902,861

[22] Filed: Sep. 2, 1986

[30] Foreign Application Priority Data

Sep. 6, 1985 [JP] Japan ..... 60-137234
Sep. 6, 1986 [JP] Japan ..... 60-198059

[51] Int. Cl.[4] ..... H01P 1/208; H01P 7/06; H01P 3/12

[52] U.S. Cl. ..... 333/212; 333/209; 333/232; 29/600

[58] Field of Search ..... 333/202, 208–212, 333/227–235, 219, 239, 245, 248; 29/600

[56] References Cited

U.S. PATENT DOCUMENTS 3,137,828 6/1964 Gerig et al. ..... 333/202 X
4,320,367 3/1982 Boujet ..... 333/209
4,396,896 8/1983 Williams ..... 333/212

FOREIGN PATENT DOCUMENTS 163823 10/1953 Australia ..... 333/212

*Primary Examiner*—Marvin L. Nussbaum
*Attorney, Agent, or Firm*—Guy W. Shoup

[57] ABSTRACT

A waveguide filter for use in a communication system that treats microwaves or millimetric waves comprises waveguides of a U-shaped cross section and a support on which the waveguides are longitudinally connected in series. Two inductor plates bear on each of the waveguides to form a waveguide resonator. Each inductor plate has first and second planes meeting at right angles. Thus, each inductor plate assumes an L-shaped form. Each first plane covers the corresponding longitudinal U-shaped end of the waveguides. Each second plane covers half of the corresponding open bottom of the waveguides, and has a tongue formed by two notches. This tongue can be bent and inserted into the corresponding waveguide to adjust the center frequency of the passband of the bandpass filter formed by the waveguide filter.

4 Claims, 12 Drawing Figures

WAVEGUIDE FILTER

FIELD OF THE INVENTION

The present invention relates to a waveguide filter for use in a communication system that treats microwaves or millimetric waves.

BACKGROUND OF THE INVENTION

In satellite communications, the satellite is very distant from earth-base stations. When the satellite is a geostationary satellite, the distance reaches 35,900 km. Therefore, radiowaves received by receivers are quite weak. Those filters which process these weak waves are required to pass them with low attenuation. Waveguide filters having high selectivity Q have been frequently used as less lossy filters. Also, the transmission station transmits waves with large power and so the energy that is dissipated while being transmitted may be converted into thermal energy, which heats the transmitter equipments. Therefore, waveguide filters exhibiting less lossy properties have been often employed in the same manner as in receivers.

The fundamental structure of a conventional waveguide filter is shown in FIG. 5, where a waveguide 20 of a rectangular cross section is partitioned into a plurality of waveguide resonators by shunt inductor plates 21–28. Thus, a bandpass filter is formed, and this is called a waveguide filter of the shunt inductor type. More specifically, the inductor plates 21–28 form inductor windows. The portion of the waveguide 20 which is defined by the inductor plates 21, 22, 25, 26 forms one waveguide resonator. The portion of the waveguide 20 which is defined by the inductor plates 22, 23, 26, 27 forms another waveguide resonator. Also, the portion of the waveguide 20 which is defined by the inductor plates 23, 24, 27, 28 forms a further waveguide resonator. In this way, the waveguide filter, or bandpass filter, is made up of these three stages of waveguide resonators. The center resonant frequency and the passband width are determined by the width and height of the tube constituting the waveguide 20, the distance between the successive inductor plates, and the width or size of the induction windows formed by the inductor plates 21–28.

The structure of the waveguide filter already proposed by the present applicant is now described in detail by referring to FIGS. 6 and 7. FIG. 6 is an exploded perspective view of this filter. FIG. 7 is a perspective view of the filter, and in which the filter has been assembled. Shown in these figures are waveguides 29–33, inductor plates 34–37 provided with induction windows 40–43, respectively, flanges 38, 39, and a support 44. The waveguides 30–32 are so machined that their dimensions are matched to the center frequency of the bandpass filter. The inductor plates 34–37 are provided with rectangular induction windows 40–43, respectively, which have a width permitting the filter to act as a bandpass filter. Since the waveguides 29 and 33 have no relation to the frequency of the bandpass filter, their length is set to any desired value. When the filter is assembled, the waveguides 29 and 33 are first placed at both ends. Then, the waveguides 29–33 and the inductor plates 34–37 are alternately arranged such that following the waveguide 29 come the inductor plate 43, the waveguide 30, the inductor plate 35, and so on. Subsequently, they are placed on the support 44 which is slightly shorter than the total length of the arrayed waveguides 29–33 and inductor plates 34–37. Then, flanges 38 and 39 are caused to bear against both ends of the support 44, and are firmly fastened to the support with screws to intimately connect the waveguides 29–33 and the inductor plates 34–37.

The waveguide 30 shown in FIGS. 6 and 7 is shown in FIG. 8 to an enlarged scale. The inside of the waveguide 30 is machined usually by drilling or electric discharge. At the four corners, the neighboring sides never intersect at right angles. Therefore, the cross section at the four corners tends to draw an arc-shaped form having a radius of about 0.2 to 0.5 mm.

FIG. 9 is a perspective view of a stub-type adjusting circuit having means for finely adjusting the center frequency of the aforementioned waveguide. This circuit comprises a waveguide 45 of a rectangular cross section. A metal screw 46 is mounted at the longitudinal center of the waveguide 45 and extends at right angles to the longitudinal direction so as to be moved into, or withdrawn from, the waveguide. The screw 46 is locked by a lock nut 47. The screw 46 is appropriately inserted into the waveguide 45 to control the intensity of the electric field, for adjusting the center frequency of the passband.

The inside of the waveguide filter already proposed by the present applicant is difficult to machine with ordinary machining techniques, beause it is cylindrical in shape as mentioned previously. The corners tend to assume an arc-shaped form of a radius of about 0.2 to 0.5 mm. Therefore, the width and height of the waveguide tend to deviate from the designed values. This causes the paths that electric currents flowing on the surface follow vary in length, elevating the center frequency. For example, a waveguide filter having a center frequency of 50 GHz has an inside width of 4.78 mm and an inside height of 2.39 mm. If the four corners are shaped into an arc-shaped form of a radius of about 0.2 to 0.5 mm, then the center frequency is shifted upward by approximately 500 MHz. In this way, the pipes of the waveguides 29–33 are difficult to machine and are not adapted for mass production.

Referring next to FIG. 10, there are show a waveguide 48 and an inductor plate 49 that covers one longitudinal end of the waveguide 48. The waveguide 48 assumes a U-shaped cross section when taken at right angles to the longitudinal direction. Similarly, the inductor plate 49 takes a U-shaped form to form an induction window. Thus, the waveguide 48 is easy to machine. As a result, none of the corners of the waveguide are shaped into arc-shaped form.

However, as shown in FIG. 11, when waveguides 48 and inductor plates 49 constructed as shown in FIG. 10 are mounted on a support 44, it is impossible to press the inductor plates 49 against the support 44, because the inductor plates 49 are very thin. Therefore, the inductor plates 49 do not make good contact with the support 44 at locations 62. This impedes the flow of surface currents, increasing the loss in the passband. Further, the passband width varies from product to product.

The metal screw 46 of the adjusting circuit shown in FIG. 9 is screwed into the waveguide 45 as shown in the enlarged cross section of FIG. 12. When the screw 46 is rotated for adjustment, the point at which the screw 46 is in contact with the waveguide 45 changes discontinuously from n to m. This abruptly changes the paths 63 that surface currents follow, making continuous adjustment impossible. Hence, it is difficult to make fine adjustment. For this reason, the screw 46 of the adjusting circuit for the waveguide filter whose center frequency of the passband lies in 50 GHz band has a small diameter of 1.2 to 1.5 mm and a pitch of 0.3 to 0.4 mm, in order to minimize the interval between the points at which the screw 46 makes contact with the waveguide 45, with unsatisfactory result. Another problem arises from the fact that the crests of the screw 46 form a part of the paths 63 that surface currents follow. That is, the paths 63 are uneven, presenting large resistances at high frequencies. This results in a large loss in the passband.

SUMMARY OF THE INVENTION

The invention is intended to alleviate the foregoing problems with the prior art devices. That is, it is an object of the invention to provide a waveguide filter which is easy to machine, prevents the center frequency of the passband from shifting, presents low resistances at high frequencies, less attenuates transmitted waves, and does not vary in passband width from product to product.

It is another object of the invention to provide a waveguide filter which permits the electric field intensity to be controlled, thus enabling stable fine adjustment of the center frequency of the passband.

These objects are achieved in accordance with the teachings of the invention by a waveguide filter comprising: waveguides each of which has a length matched to the center frequency of the passband of the bandpass filter formed by the waveguide filter, each waveguide assuming a U-shaped cross section when taken at right angles to the longitudinal direction; shunt inductor plates each f which has first and second planes meeting at right angles and assumes an L-shaped form, each first plane covering the corresponding one of the longitudinal open ends of the waveguides, each second plane covering the corresponding one of the open bottoms of the waveguides, each first plane being provided with an induction window, each second plane having a tongue formed by notches, the shunt inductor plates bearing on their corresponding waveguides to form waveguide resonators; and a support on which the waveguide resonators are longitudinally connected in series, the support being provided with adjusting windows that face their respective tongues formed in the second planes; whereby the center frequency of the passband can be controlled by appropriately bending the tongues.

In one feature of the invention, the cross section of each waveguide that is taken at right angles to the longitudinal direction assumes a U-shaped form to thereby facilitate machining the waveguide. Especially, the corners of each waveguide can be machined into right angles, preventing the center frequency of the passband of the waveguide filter from shifting.

In another feature of the invention, each inductor plate has first and second planes which meet at right angles and hence the inductor plate assumes an L-shaped form. Each first plane covers the corresponding one of the open longitudinal ends of the waveguides, while each second plane covers the corresponding one of the open bottoms of the waveguides. The waveguides can be brought into intimate contact with the support while a portion of each inductor plate bears on the bottom walls of the corresponding waveguide. Hence, the waveguide filter presents small resistances at high frequencies, showing low losses in the passband. Further, the passband width does not vary widely from product to product.

In a further feature of the invention, each inductor plate is provided with the tongue that can be bent at will. This permits the electric field intensity to be controlled without varying the paths that surface currents follow. Consequently, the center frequency of the passband can be finely adjusted stably. Hence, the center frequency can be set accurately.

Other objects and features of the invention will appear in the course of the description thereof which follows.

DETAILED DESCRIPTION OF THE INVENTION

Figure 1:
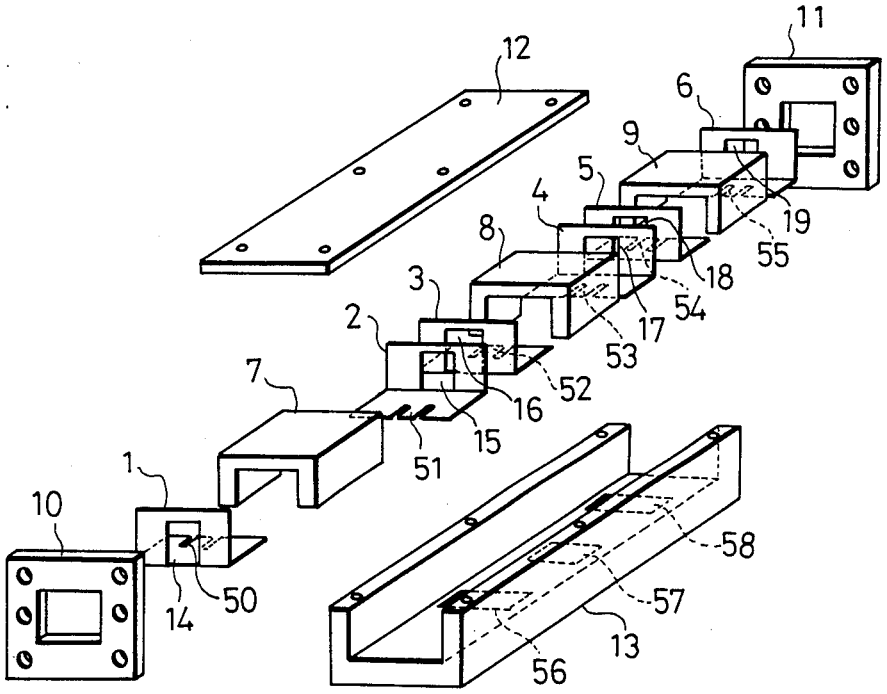
FIG. 1 is an exploded perspective view of a waveguide filter according to the invention.
Figure 2:
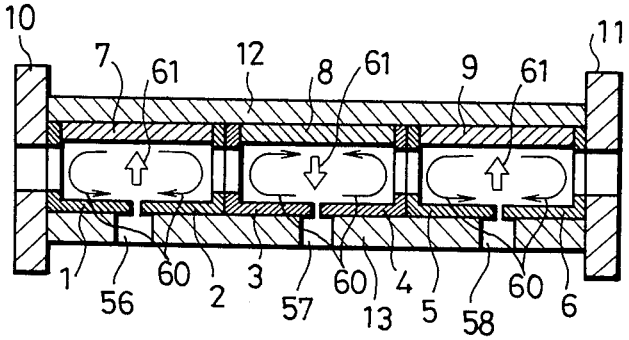
FIG. 2 is a cross-sectional view taken in the longitudinal direction of the waveguide filter shown in FIG. 1, and in which the filter has been assembled.

Referring to FIGS. 1 and 2, there is shown a waveguide filter embodying the concept of the present invention. This filter has inductor plates 1–6, waveguides 7–9 that assume a U-shaped cross section when taken at right angles to the longitudinal direction, flanges 10, 11, a cover 12, and a support 13. The inductor plates 1–6 are provided with induction windows 14–19, respectively. The waveguides 7–9 are so machined that their width and height are matched to the center frequency of the bandpass filter to be realized. The bottoms of the waveguides 7–9 of the U-shaped cross section are open. Each of the inductor plates 1–6 has first and second planes meeting at right angles and hence each inductor plate assumes an L-shaped form. The first plane of each inductor plate covers the corresponding one of the open longitudinal ends of the waveguides 7–9, while the second plane covers the corresponding one of the open bottoms of the waveguides. The first planes of the inductor plates 1–6 which cover the open longitudinal ends of the waveguides 7–9 are provided with induction windows 14–19, respectively. These windows are wide enough to form a bandpass filter. The second planes of the inductor plates 1–6 bear on the bottom walls of the waveguides 7–9 and cover the open bottoms of the waveguides 7–9. The second planes have bendable tongues 50–55 formed by hotches. The support 13 is provided with adjusting windows 56–58 that face the tongues 50–55, respectively. The open longitudinal ends and the open bottom of the waveguide 7 are covered with the inductor plates 1 and 2 to form a waveguide resonator. The inductor plates 1 and 2 that cover the bottom of the waveguide 7 are in contact with each other at the longitudinal center of the waveguide 7. Similarly, the waveguide 8 cooperates with the inductor plates 3 and 4 to form another waveguide resonator. The waveguide 9 cooperates with the inductor plates 5 and 6 to constitute a further waveguide resonator. These three waveguide resonators are mounted on the support 13. The flanges 10 and 11 are firmly fastened to both ends of the support 13 with screws (not shown). The cover 12 is screwed to the top of the support 13. The three waveguide resonators are connected in series to form a waveguide filter that acts as a bandpass filter.

Figure 3:
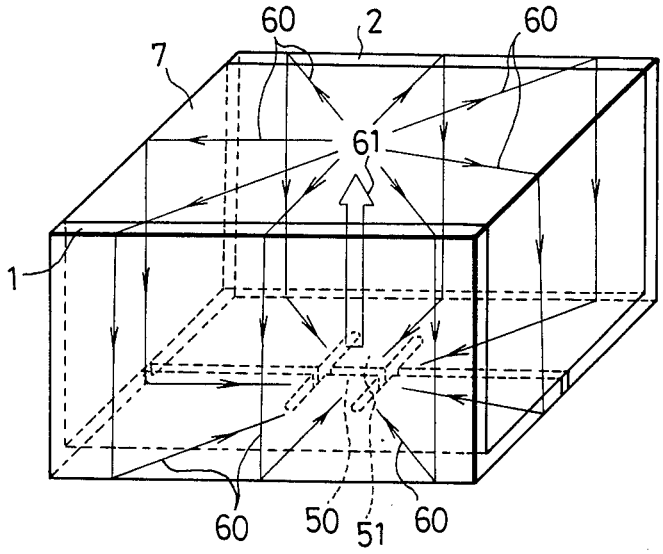
FIG. 3 is a perspective view of the waveguide resonators of the filter shown in FIG. 1, for illustrating surface currents and an electric field.
Figure 4:
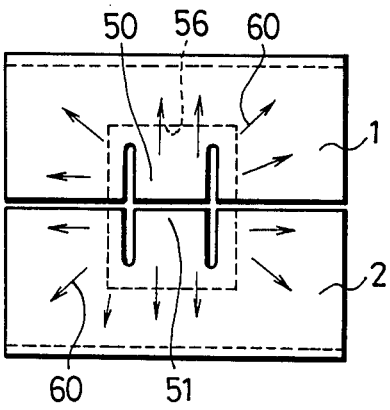
FIG. 4 is a bottom view of one of the waveguides shown in FIG. 1, for illustrating the surface currents flowing through the inductor plate covering the bottom of the waveguide.
Figure 5:
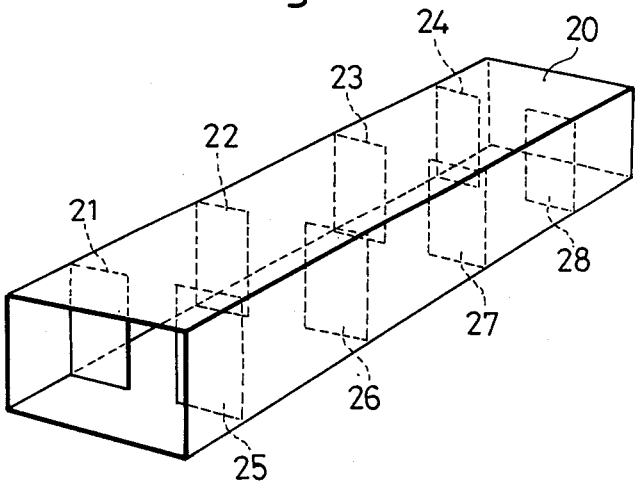
FIG. 5 is a perspective view of a fundamental waveguide filter.
Figure 6:
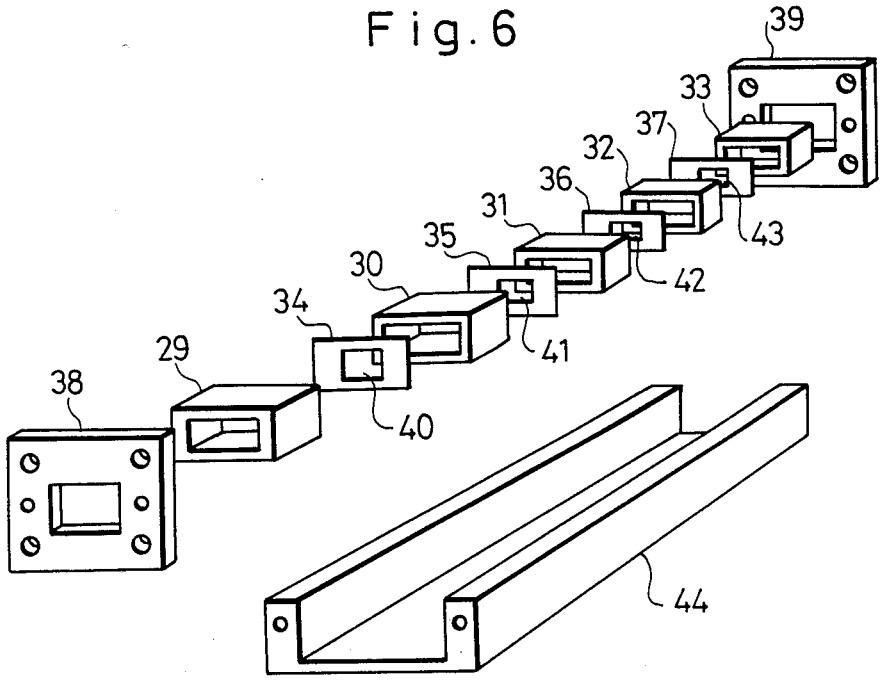
FIG. 6 is an exploded perspective view of the waveguide filter already proposed by the present applicant, for particularly showing the structure.
Figure 7:
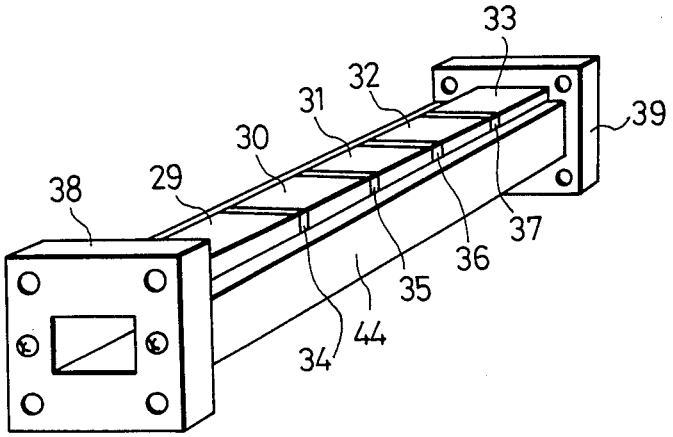
FIG. 7 is a perspective view of the waveguide filter shown in FIG. 6, and in which the filter has been assembled.
Figure 8:
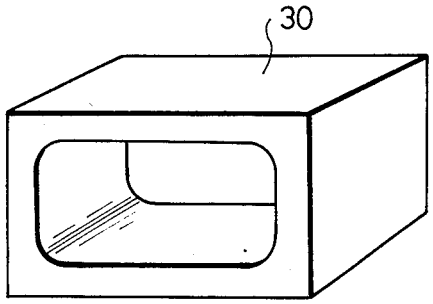
FIG. 8 is an enlarged perspective view of one of the waveguides constituting the waveguide filter shown in FIG. 6.
Figure 9:
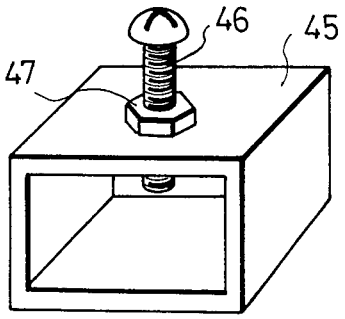
FIG. 9 is a perspective view of a stub-type adjusting circuit for finely adjusting the center frequency of a passband.
Figure 10:
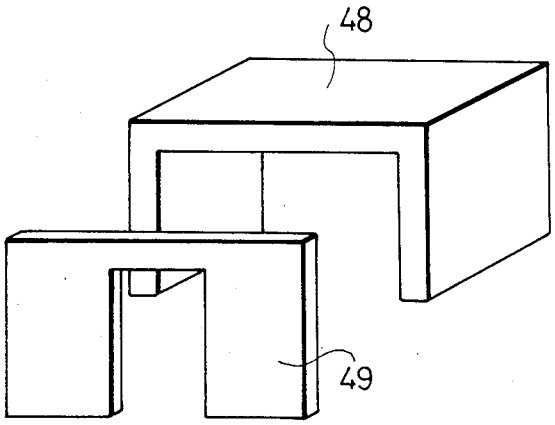
FIG. 10 is a perspective view of another structure that permits the waveguide shown in FIG. 8 to be machined with ease.
Figure 11:
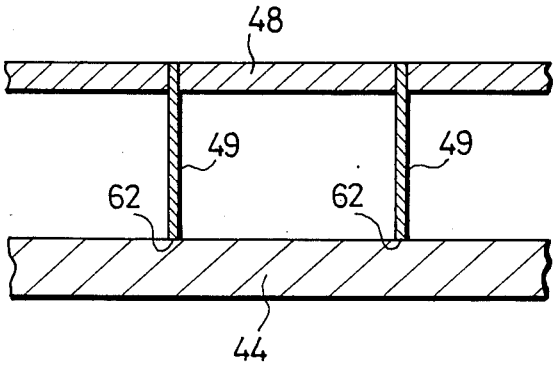
FIG. 11 is a cross-sectional view of the structure shown in FIG. 10, for illustrating the problems with the structure.
Figure 12:
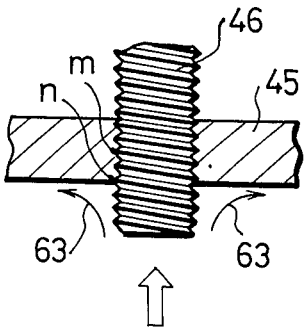
FIG. 12 is an enlarged cross section of the adjusting circuit shown in FIG. 9, for showing the manner in which a metal screw is screwed into a waveguide.

Referring next to FIGS. 3 and 4, there is shown the waveguide resonator formed by the waveguide 7 and the inductor plates 1 and 2. Electric currents flowing on the surface of this resonator are indicated by arrows 60. The electric field produced in this resonator is indicated by arrow 61. The inductor plates 1 and 2 are in contact with each other at the center of the bottom surface of the waveguide 7. On the upper surface as viewed in FIG. 3, surface currents 60 radially flow out of the center. On the lower surface, surface currents 60 flow toward the center. Since the inductor plates 1 and 2 are in contact with each other at the longitudinal center, the surface current 60 do not flow across the intersection line of the inductor plates 1 and 2.

Referring to FIGS. 1–4, the tongues 50–55 can be bent at will from the adjusting windows 56–58 of the support 13 to control the intensity of the electric field 61. Thus, the center frequency of the passband can be finely adjusted. Even if the tongues 50–55 are bent, the flow of the surface currents 60 hardly changes. Hence, it is possible to make fine adjustment stably. Further, the paths that the electric currents follow are not uneven, unlike the conventional stub-type adjusting circuit. Therefore, the novel filter does not exhibit high resistances at high frequencies. Also, the filter does not show low selectivity Q. Thus, the loss in the passband is low. Furthermore, the passband width does not vary widely from product to product.

As described thus far, the waveguide filter according to the invention comprises waveguides each of which assumes a U-shaped cross section when taken at right angles to the longitudinal direction. These waveguides are easy to machine. Especially, the corners of the waveguides can be machined into right angles. This prevents the center frequency of the passband of the waveguide filter from shifting. Each inductor plate assumes an L-shaped form consisting of first and second planes. Each first plane covers the corresponding one of the open longitudinal ends of the waveguides. Each second plane covers the corresponding one of the open bottoms of the waveguides. The waveguides can be brought into inimate contact with a support in such a way that portions of the inductor plates bear on the bottom walls of the waveguides. Consequently, the novel filter presents only small resistances at high frequencies, and therefore it less attenuates transmitted waves than the conventional device. Further, the passband width does not vary widely from product to product. Each inductor plate is provided with a bendable tongue. The intensity of the electric field can be controlled without changing the surface current paths by appropriately bending the tongues. In this way, the center frequency of the passband can be finely adjusted stably. Hence, the center frequency of the passband can be accurately set.

What is claimed is:

1. A waveguide filter comprising:

waveguides each of which has a length matched to the center frequency of the passband of the bandpass filter formed by the waveguide filter, each waveguide assuming a U-shaped cross section when taken at right angles to the longitudinal direction;

shunt inductor plates each of which has first and second planes meeting at right angles and assumes an L-shaped form, each first plane covering the corresponding one of the open longitudinal ends of the waveguides, each second plane covering the corresponding one of the open bottoms of the waveguides, each first plane being provided with an induction window, the shunt inductor plates bearing on their corresponding waveguides to form waveguide resonators; and a support on which the waveguide resonators are longitudinally connected in series.

2. A waveguide filter comprising:

waveguides each of which has a length matched to the center frequency of the passband of the bandpass filter formed by the waveguide filter, each waveguide assuming a U-shaped cross section when taken at right angles to the longitudinal direction;

shunt inductor plates each of which has first and second planes meeting at right angles and assumes an L-shaped form, each first plane covering the corresponding one of the open longitudinal ends of the waveguides, each second plane covering the corresponding one of the open bottoms of the waveguides, each first plane being provided with an induction window, each second plane having a tongue formed by notches, the shunt inductor plates bearing on their corresponding waveguides to form waveguide resonators; and a support on which the waveguide resonators are longitudinally connected in series, the support being provided with adjusting windows that face their respective tongues formed in the second planes;

whereby the center frequency of the passband can be controlled by appropriately bending the tongues.

3. A waveguide filter as set forth in claim 1, wherein each of the waveguides cooperates with its corresponding two of the inductor plates to form one waveguide resonator.

4. A waveguide filter as set forth in claim 2, wherein each of the waveguides cooperates with its corresponding two of the inductor plates to form one waveguide resonator.

* * * * *